US007113609B1

(12) United States Patent
Neidich et al.

(10) Patent No.: US 7,113,609 B1
(45) Date of Patent: Sep. 26, 2006

(54) VIRTUAL MULTICHANNEL SPEAKER SYSTEM

(75) Inventors: Michael I. Neidich, Santa Clara, CA (US); Paul R. Goldberg, Palo Alto, CA (US); Mitchell A. Golner, Los Gatos, CA (US)

(73) Assignee: Zoran Corporation, Sunnyvale, CA (US)

( * ) Notice: Subject to any disclaimer, the term of this patent is extended or adjusted under 35 U.S.C. 154(b) by 0 days.

(21) Appl. No.: 09/325,893

(22) Filed: Jun. 4, 1999

(51) Int. Cl.
*H04R 5/02* (2006.01)

(52) U.S. Cl. ..... 381/305; 381/303; 381/103; 381/17

(58) Field of Classification Search ..... 381/303, 381/103, 300, 304, 307, 305, 308
See application file for complete search history.

(56) References Cited

U.S. PATENT DOCUMENTS

| | | | | |
|---|---|---|---|---|
| 3,104,729 | A * | 9/1963 | Olson | 181/145 |
| 3,236,949 | A | 2/1966 | Atal et al. | |
| 4,450,322 | A | 5/1984 | Wilson | |
| 4,823,391 | A * | 4/1989 | Schwartz | 381/103 |
| 4,888,809 | A * | 12/1989 | Knibbeler | 381/103 |
| 5,386,478 | A * | 1/1995 | Plunkett | 381/103 |
| 5,404,406 | A | 4/1995 | Fuchigami et al. | |
| 5,521,981 | A | 5/1996 | Gehring | |
| 5,553,149 | A | 9/1996 | Freadman | |
| 5,581,626 | A * | 12/1996 | Palmer | 381/103 |
| 5,661,808 | A | 8/1997 | Klayman | |
| 5,727,066 | A | 3/1998 | Elliott et al. | |
| 5,751,815 | A * | 5/1998 | Philp et al. | 381/17 |
| 5,798,922 | A | 8/1998 | Wood et al. | |
| 5,802,180 | A | 9/1998 | Abel et al. | |
| 5,809,149 | A | 9/1998 | Cashion et al. | |
| 5,812,674 | A * | 9/1998 | Jot et al. | 381/17 |
| 5,815,578 | A | 9/1998 | Foster et al. | |
| 5,838,800 | A | 11/1998 | Lowe et al. | |
| 5,862,227 | A | 1/1999 | Orduña-Bustamante et al. | |
| 6,169,806 | B1 * | 1/2001 | Kimura et al. | 381/17 |
| 6,195,435 | B1 * | 2/2001 | Kitamura | 381/18 |

FOREIGN PATENT DOCUMENTS

| | | |
|---|---|---|
| DE | 40 27 338 A1 | 3/1992 |
| DE | 43 07 490 A1 | 9/1994 |

(Continued)

OTHER PUBLICATIONS

Bauer, B.B., "Stereophonic Earphones and Binaural Loudspeakers," *Journal of The Audio Engineering Society*, vol. 9, No. 2 (Apr. 1961), pp. 148-151.

(Continued)

*Primary Examiner*—Brian T. Pendleton
(74) *Attorney, Agent, or Firm*—Parsons Hsue & de Runtz LLP

(57) ABSTRACT

A virtual multichannel sound system is presented to improve audio reproduction by statically or dynamically conforming signal processing to specific speaker characteristics and/or arrangements. According to one such aspect, one or more dynamic signal processing algorithms driving two or more speakers are altered in response to the relative physical characteristics or arrangements of these speakers, where parameter information for these algorithms is either factory set, user input, or automatically supplied to the processor. Examples of such relative speaker differences include speaker spacing or alignment, speaker or enclosure compliance, and enclosure configuration. Another aspect is to alter the processing algorithms in response to common speaker characteristics for certain conditions of input signals. An example of this aspect is to alter the signal processing to improve bass response as a function of bass content in the signals being presented to the speakers and speaker size as well as relative speaker position.

25 Claims, 9 Drawing Sheets

FOREIGN PATENT DOCUMENTS

| | | |
|---|---|---|
| EP | 1 183 911 B1 | 8/2004 |
| WO | WO9401981 | 1/1994 |

OTHER PUBLICATIONS

*Audio Engineering Society UK DSP Conference*, Held Sep. 14-15, 1992—Kensington Town Hall—London, Chairman: Rhonda Wilson, "Multichannel Signal Processing Techniques in the Reproduction of Sound," Section: 1. Multi-Channel Inverse Filtering Using a Lease Squares Formulation, pp. 155-174.

International Searching Authority, PCT Application No. PCT/US00/13415 on May 16, 2000.

* cited by examiner

VIRTUAL MULTICHANNEL SPEAKER SYSTEM

BACKGROUND OF THE INVENTION

This invention relates generally to sound reproduction systems and, more specifically, to the enhancement of multichannel sound reproduction through improved speaker arrangement and the relation of this arrangement to audio signal processors and their algorithms.

A number of systems have been proposed for expanding the stereo image present in stereo source material. These systems employ a number of techniques and algorithms to expand the stereo image beyond the confines of the left and right speakers. Such systems have also been adapted to source material with more than two independent input channels, and for use with more than two speakers. These find application in computer sound playback, home and car audio systems, and many other applications based on material from any of the many computer storage systems, video and audio cassettes, compact discs, FM broadcasts, and all other available stereo and multichannel media.

The generic stereo or two output channel arrangement of the prior art is shown in FIG. 1. A listener 10 is positioned some distance D away from the midpoint between a pair of speakers 13 and 14. This midpoint is taken as the origin of the reference coordinates (x,y), with the X-axis extending as shown toward the primary listening area. In a general placement, each of the speakers, 13 and 14, will be different distance from the listener 10 and, in particular, a different distance from each of the listener's ears 11 and 12. The signals to the right speaker 14 and the left speaker 13 are supplied from an audio signal processor 17 along lines 16 and 15, respectively. The signal processor produces the output signals along 15 and 16 based upon the audio signals input from lines 18. In the case of a 2 input, 2 output, or 2-2, signal processor, there are only two input lines 18.

In the simplest case, the signal processor is absent and a pair of input lines 18 from a stereo audio source are then the same as lines 15 and 16 and there is no enhancement of the stereo signals. When a signal is transmitted from a single speaker, say the right speaker 14, the listener identifies the location of the speaker as $(x_r,y_r)$ based on the difference between what is perceived at the right ear 12 and what is perceived at the left ear 11. This difference in perception is due, firstly, to the difference in path lengths between the right speaker and the right ear, $d_{rr}$, and between the right speaker and the left ear, $d_{rl}$, and to a difference in audio level. This difference produces a corresponding delay in the signal at the left ear as it must propagate the additional distance $\Delta d_r = d_{rl} - d_{rr}$. But there are also additional effects: These arise as the head of the listener 10 is not acoustically transparent to the sound waves and will alter them as they propagate around the head to the left ear 11. This filtering effect is described in terms of Head Related Transfer Functions (HRTFs). This combination of signal delay and alteration as perceived by the listener contribute to how the source of the sound is identified as being at the point $(x_r,y_r)$.

To produce a sound that the listener will perceive as being located at an arbitrary point (x,y), a speaker 19 would ideally, but impractically, be placed at each such position (x,y). To produce the sounds across the entire front field of the listener, such as is desired for home theater, computer games, or many other uses, would therefore require a vast number of speakers and a corresponding number of independent signals for this surround sound or multichannel effect. To mimic this effect, the psycho-acoustical mechanisms that allow the listener to fix the location of a sound source can be exploited through delay and HRTFs.

A number of different algorithms exist for this purpose and are widely know in the art. Examples and sources include Dolby Laboratories, Q-Sound Corporation, Spatializer Corporation, Aureal Semiconductor, Harman International, and SRS True Surround. These would then be employed inside the signal processor 17 to produce output signals on lines 15 and 16. There may be more than two inputs signals, for instance in the case of 5.1 home theater system which employ left, right, and center forward channels as well as left and right surround channels. These algorithms rely upon encoding/decoding schemes to create a spatial representation of recorded materials, allowing them to place the sound at the perceived location (x,y) of a virtual speaker 19 without requiring a physical speaker at this location.

These signal processing algorithms employ delay, HRTFs, inter-aural crosstalk cancellation, and other methods known in the field of binaural hearing using two speakers. A generic example of such a prior art signal processor is shown in FIG. 2 as a block diagram for the case of two input signals 18. For a signal L entering the left input channel of 17, this signal is also supplied to the right output channel at the adder 28 after going through the inverter 22 and having its amplitude diminished and delayed by block 25. By including this out of phase, delayed, and diminished version of the signal L in the right output signal R' and transmitting it to the right speaker in addition to supplying the signal L to the left speaker, the perceived source of the sound is de-localized from the left speaker. A similar process, based on inverter 21 and block 24, produces a signal from the right input R that adder 27 combines to L to form output signal L' that de-localizes signals from the right channel. By further incorporating HRTFs into blocks 24 and 25, along with similar processing in the blocks 23 and 26, it possible to simulate the psycho-acoustic stimuli of multichannel or surround stereo with only a pair of speakers. Additionally, by a proper construction of HRTFs, variations in the vertical position, a suppressed z direction in FIG. 1, may also be mimicked.

Although these algorithms as embodied in a signal processing circuit can be effective in enhancing stereo reproduction to produce virtual multichannel or surround sound, there are a number of shortcomings. A primary one of these is inherent in the algorithms themselves: To produce the output signals L', R' from the input signals L, R requires a number of assumptions to be made about both the location of the speakers 13 and 14 as well as the actual speakers themselves. For the various processing blocks 23, 24, 25, and 26 to provide the correct delays, HRTFs, and so on requires the algorithm to assume a particular speaker separation and alignment modeled on point-like speakers. It must also make a series of assumptions about speaker response, particularly about the differential response of one speaker relative to the other.

As these assumptions are built into the signal processor, it is important that the speakers are spaced correctly and, preferable, slightly above the listener: For the proper psycho-acoustical response, the physical speaker separation is more important than the Y location of the listener, with the listener's X position even less critical. Users frequently place speakers in an arbitrary manner for any number of practical or aesthetic reasons, because the size or purpose of the correct physical separation is not known, or based on the incorrect assumption that a wider physical separation produces a better result. Additionally, for some computer monitors and other uses, the speakers are often fixed, but in a position that may be incorrect as the algorithm used may have been based on the speaker position of, say, a car. These defects undermine the algorithm at the core of the signal processor and are a serious limitation in the prior art.

The alignment, or azimuthal angle, or the speaker axis also affects the sound received by the listener. The above example of speaker placement in a car compared to that in a home computer system is also illustrative of this problem: Car speakers are often placed in the doors of the automobile where the sound will come from the listener's sides, while personal computer applications usually place the speaker to the front of the listener. Aside from any change in relative delay of amplitude this may cause, these two placements will require different HRTFs as the sound will propagate around the listener on a different path. Even with the alignment of the application for which the algorithm was designed, aligning one speaker askew to the other speaker will create another differential response that will undermine the algorithm.

The assumptions about the speakers themselves include idealizing them as having the same response to a given input signal. Whether through using improperly matched speakers, differences in how they are connected, or even manufacturing variations, actual speaker pairs will, to degree or another, have relative variations. Such variations will not only degrade the enhanced stereo algorithms described above, but also more "traditional" or non-enhanced stereo reproduction. Some of the more basic differences resulting from differences in things such as speaker or enclosure compliance can be addressed by balance controls or graphic equalizers, but these are not concerned with the sort of dynamic signal processing, related to phase or other such parameters, such as is used for virtual speaker placement.

One method known in the art for improving such enhanced stereo schemes is to employ one of the matrix encoding-decoding processes known in the literature for creating a spatial representation of recorded material, examples including ProLogic, Circle Surround, and Logic 7. Such schemes are dependent on special source material encoding. Generically, these processes start with n distinct sound channels that are matrix encoded into l channels for an n:l encoding. At the reproduction stage, these l channels are then subjected to l:m matrix decoding to produce m output signals. Aside from other shortcoming, these algorithms still suffer from the need for proper speaker placement, but now have the additional complication that the signal processor must be able to handle the proper decoding scheme, which may or may not be compatible with other input material for the processor.

One way to overcome some of these limitations is, of course, to introduce more independent sound channels and the corresponding speakers, as is done for instance in the Dolby Digital, Sony SDS, or DTS 5.1 channel cinema sound recording or Direct X computer game sound. All of these examples employ a pair of rear channels to provide stereo sound from the back. Although this may improve sound from the rear to produce a more realistic representation, it still leaves the previous limitations for the more important front sound channels. Additionally, although the psychoacoustic localization of sound from the rear is less acute than from the front, the inclusion of rear speakers now introduces all of the speaker placement problems inherent in enhanced stereo algorithms to rear speakers as well as the front, though less critically so.

Similarly, such multichannel or matrix sound system would benefit from an increase in the number of actual speakers, although a method would be needed to produce the signals suitable for these extra speakers. Once again, proper placement of these speakers is needed for the best results.

Therefore, one objective of the present invention is to reduce these limitations by presenting an audio signal processor responsive to information on speaker placement and response. A second objective of the present invention is to reduce these limitations in such a manner as to not require intentional pre-encoding of the source material and is, therefore, of immediate use and applicability to current stereo recordings. Such improvements would also have applicability for producing virtual multichannel enhanced stereo as well as for non-enhanced, conventional multichannel sound.

Other objectives are to present a speaker mechanism that holds the speakers in a set spatial relationship, either fixed or adjustable to each other and including a sensor mechanism to provide data about this relationship and other relative speaker information. A further objective is to use this information to effect variation in the algorithm employed by the audio signal processor.

An additional objective of the present invention is to extend these other objectives beyond two channel stereo to matrix or multichannel audio systems by extending the same techniques to rear sound channels, and, furthermore, by such an application to produce a virtual rear center channel when only a left and right rear channel signal are provided.

A further object is to use such algorithms to provide audio signals to an even greater number of speaker pairs to flood an enclosed listening space with sounds from a greater number of directions.

SUMMARY OF THE PRESENT INVENTION

These and additional objects are accomplished by the various aspects of the present invention, wherein, briefly and generally, audio reproduction is improved by statically or dynamically conforming the signal processing to specific speaker characteristics and/or arrangements. According to one such aspect, one or more dynamic signal processing algorithms driving two or more speakers are altered in response to the relative physical characteristics or arrangements of these speakers, where parameter information for these algorithms is either factory set, user input, or automatically supplied to the processor. Examples of such relative speaker differences include speaker spacing or alignment, speaker or enclosure compliance, and enclosure configuration. Another aspect is to alter the processing algorithms in response to common speaker characteristics for certain conditions of input signals. An example of this aspect is to alter the signal processing to improve bass response as a function of bass content in the signals being presented to the speakers and speaker size as well as relative speaker position.

Additional objects, advantages, and features of the present invention will become apparent form the following description of its preferred embodiments, which description should be taken in conjunction with the accompanying drawings.

DESCRIPTION OF THE PREFERRED EMBODIMENTS

An embodiment of the present invention uses single driver speakers to improve spatial imaging by eliminating crossover network manufacturing variations in an arrangement of the speaker spacing with automatic adjustment of the digital signal processing algorithm based on the speaker spacing as sensed by the special speaker housings and connecting sleeve. Another aspect allows information on speaker spacing to be factory set or input by the user so that the signal processor may still be used with a pair of speakers not connected in a way that automatically provides this information. Conversely, a further aspect is a speaker enclosure that uses two single driver speakers in identical housings, joined by a mechanism that enables the spacing between the speakers to be set to match the width of the underlying supporting surface, such as a TV or computer monitor, by using a joining mechanism that allows the spacing to be optimized.

Figure 1:
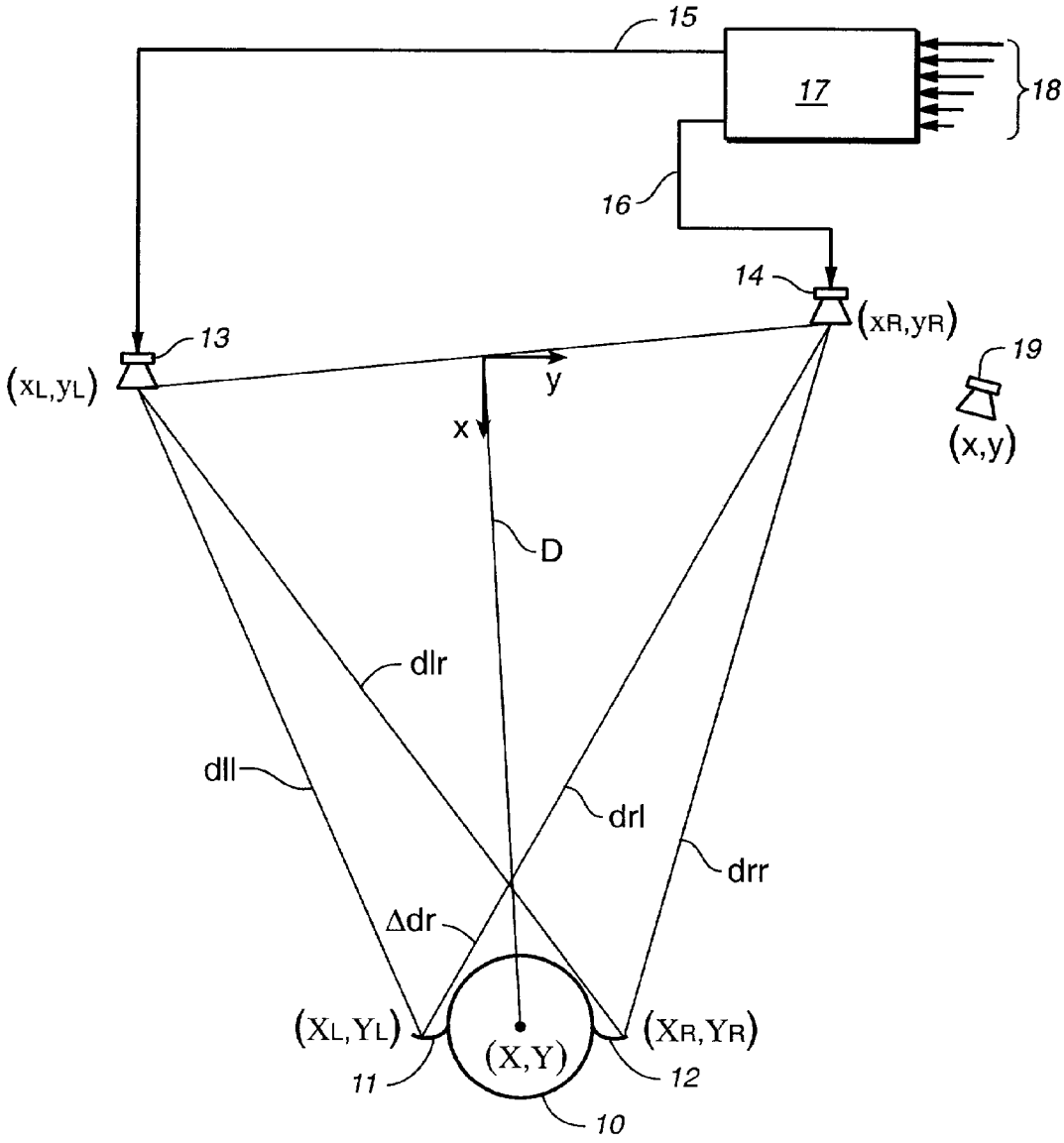
FIG. 1 (PRIOR ART)
FIG. 1 shows a prior art stereo arrangement.
Figure 2:
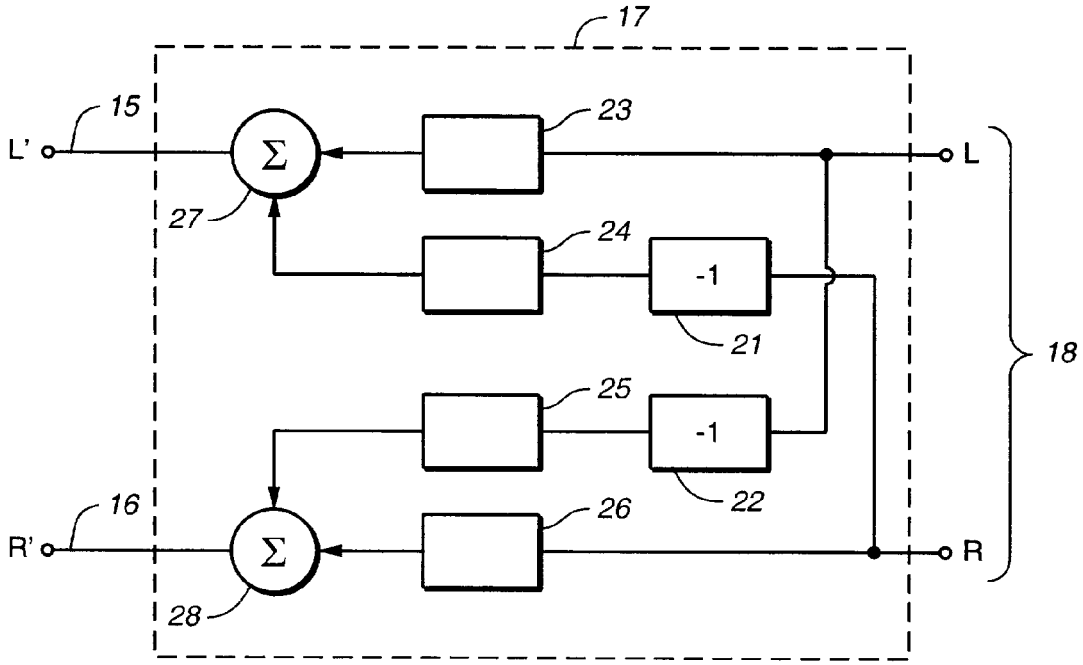
FIG. 2 (PRIOR ART)
FIG. 2 is a block diagram for an example of a prior art signal processor.
Figure 3:
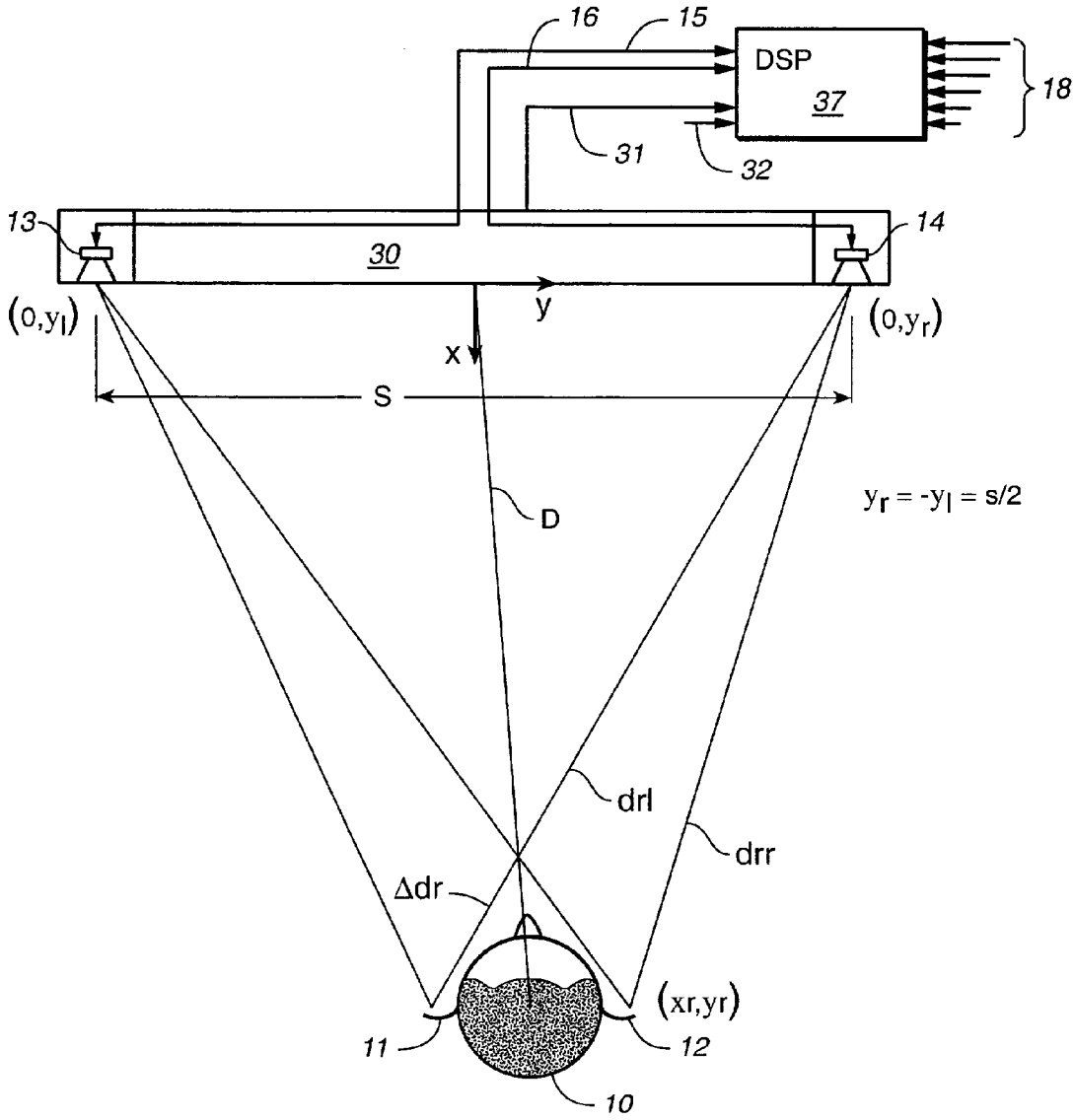
FIG. 3 shows a preferred embodiment of some aspects of the present invention.
Figure 4:
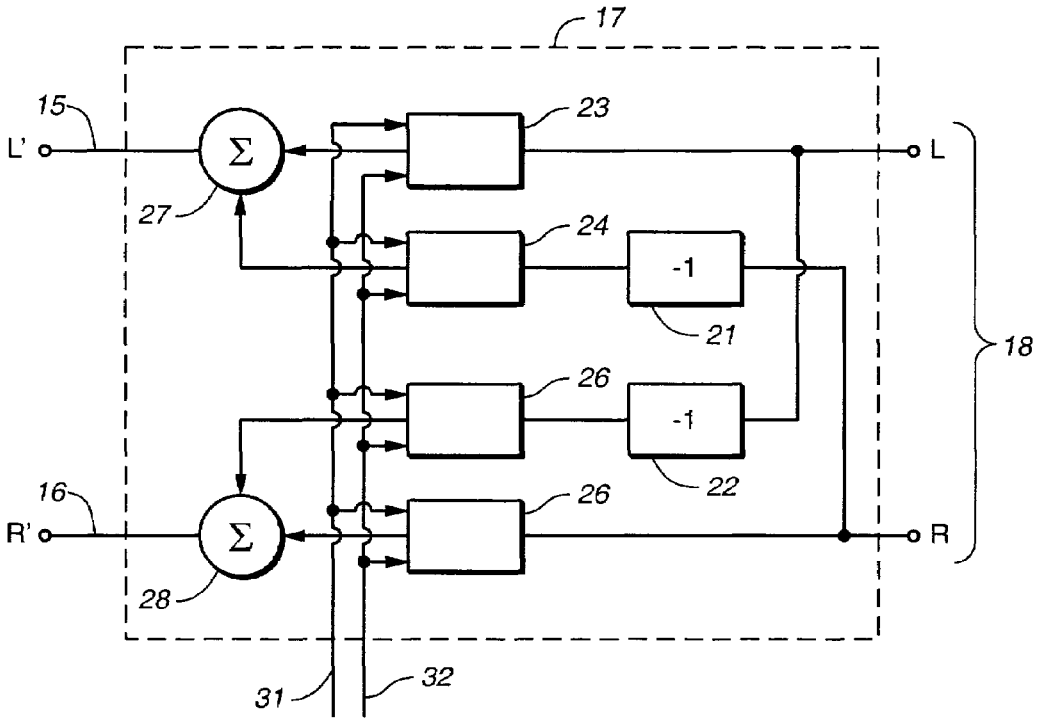
FIG. 4 is a block diagram for a signal processor in FIG. 3.

FIG. 3 shows several aspects of the present invention in this embodiment. As in FIG. 1, a listener 10 is located in front of a pair of speakers 13 and 14. The speakers are separated by a distance s from each other with their midpoint a distance D from the listener. This midpoint is taken as the origin of the reference coordinates (x,y), with the X-axis extending as shown toward the primary listening area. The speakers 13 and 14 again receive the respective input from lines 15 and 16 and the initial audio information comes in on a number of lines 18. Unlike the prior art, the speakers are now in an enclosure 30 holding the matched speakers 13 and 14 in special housings with a joining mechanism that allows adjustment of the speaker spacing. This joining mechanism contains sensors to determine this physical separation s of the speakers and supply this information on output line 31. The Digital Signal Processor (DSP) 37 can now adjust its processing algorithms in response to this input 31. Provision for the algorithms to be adjusted according to other automatic or manual inputs 32 is also included. FIG. 4 corresponds to FIG. 2, but with these parameter inputs 31 and 32 shown attached to processing blocks 23–26.

This embodiment overcomes many of the limitations found in the prior art. Using matched speakers reduces relative variations in speaker and enclosure response as these are now identical within manufacturing tolerances. By placing the speakers in a special housings 30 with a connecting sleeve, they are held at in the proper spacing and azimuthal alignment for the algorithms used in the DSP 37. That this is, in fact, the proper spacing is ensured by the speaker enclosure 30 supplying, along output 31, information on this spacing, to which the DSP 37 will automatically adjust its algorithms. As DSP 37 will now automatically adjust its algorithms to the spacing of the speakers, the enclosure allows the separation to be adjusted to user preferences and not permanently fixed. Other embodiments could measure relative speaker distance by other methods. Individual speakers with optical or sonar ranging can be employed to measure and supply the speaker's distance to the DSP 37.

The embodiment of FIG. 3 removes or minimizes many of the relative variations that undermine the effectiveness of multichannel sound reproduction as described in the background section. The inputs 31 and 32 allow for adjustments, either automatic or manual, to modify the signal processor algorithms to compensate for others. In the embodiment of FIG. 3 and other embodiments below, only the speaker spacing is given as an explicit input parameter as this is both an important example and is easily discussed and shown in the figures. More general embodiments may employ a higher dimensional space of input parameters. For example, the signal processor described above may be employed with a pair of speakers not in the described enclosure. In this case, variations in speaker and enclosure compliance, differences in enclosure configuration, and azimuthal alignment of speaker axes could also be entered into the algorithms in addition to inter-speaker separation. Preferable these and other parameters used for dynamic processing adjustments are made automatically through input 31, although manual input 32 allows them to be entered along with other information such as choice of matrix decoding scheme. The option of manual input allows the signal processor to be used with prior art speakers.

By using the automatic supply of parameters, such as inter-speaker separation s in the embodiment of FIG. 3, this aspect of the present invention allows for the automatic dynamic processing of input signals to drive the speakers based on parameters determined by the relative characteristics of the speakers. The actual parameters may be either static, such as speaker spacing, or dynamic, such as speaker compliance. A familiar prior art example of parameters that may be altered is the combination of volume and balance controls: The volume control is an input common to both channel which sets the overall loudness, while the balance control determines the relative loudness of the two channels. The balance is an example of a parameter based on relative characteristics. The sort of processing variations under consideration here are dynamic alterations in the processing algorithms affecting properties such as the phase of the signals within the processor. Aside from applications for enhanced stereo employing HRTFs and other enhancement methods, standard multichannel sound reproduction could also benefit from these techniques to offset problems due to those relative speaker differences and placement problems.

As discussed above in the Background, it is this proper physical speaker separation for a processor's algorithm that largely determines the effectiveness of that algorithm: It is more important than the listener's Y position or the even less critical X position. To exactly position the location of speakers 13 and 14, they would, as an idealization, be point sources. For this reason, one preferred embodiment employs a single driver speaker for each of 13 and 14. Since it is physically impossible to move the amount of air needed for low frequencies with small drivers, this results in a trade off between maximizing the effectiveness of the stereo enhancement of the DSP 37 and the frequency response of larger and/or multiple speakers. Another standard solution to this problem is to employ a separate subwoofer for low frequencies to exploit the psycho-acoustical effect that these low frequencies can not be localized as well as higher frequencies. This may be realized with a ported enclosure for bass.

Another solution to the lack of bass response for smaller speakers is an aspect of the present invention that can be incorporated within the embodiment of FIG. 3 or other embodiments. This would also involve automatic dynamic processing of the input signals within the signal processor, but now to improve bass response based upon speaker size as well as relative speaker position. By driving the speakers in unison, the effective bass response is improved since, functioning together, they can move a larger quantity of air. Above a chosen frequency, the individual signals would maintain the values they would have without the incorporation of this aspect. Below a second lower frequency, say 100 Hz, both channels would be provided the same output signals with the same phase. In between these two frequencies, the individual signals would transition between these two states in a smooth manner, so that there would be no abrupt change at the transition frequencies. The choice of transition frequencies and characteristics could be chosen based on speaker characteristics combined with the delocalization effect of lower frequencies. In this way, a digital signal processor may be used as a crossover network with phase adjustment to enable using single or multi-driver speakers more effectively for virtual 3D and other sound applications.

The described invention can be used to advantage in any of the applications for enhanced stereo. These include the home audio uses of rendering surround sound from stereo and matrix stereo sources, such as records, reel-to-reel and cassette tapes, VHS video cassettes, compact discs (CDs), Laserdiscs, or DVDs, and car and RV audio rendering from stereo media such as tape, radio broadcasts, CDs, or VHS video cassettes. For illustrative purposes, the next part of the discussion will, however, largely focus on computer sound playback from any of the standard sources. To simplify the figures and discussion, these again mainly use speaker separation as the single input parameter, although the other parameters described above and in the following may be included in other embodiments. Additionally, although the signal processor DSP 37 is a digital device, analog techniques could also be utilized in other embodiments.

Figure 5:
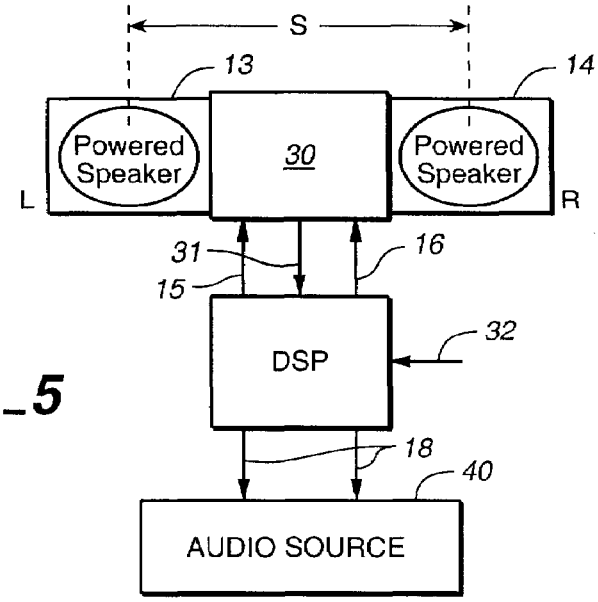
FIG. 5 is a block diagram of these aspects applied to a personal computer.

In this context of a PC, FIG. 5 shows a block diagram of a preferred embodiment. The audio source 40, such as a PC sound card, supplies a left and right signal on lines 18 to the DSP 37. As these may be encoded by any number of the standard schemes available, the DSP 37 will also include the corresponding decoding process in connection with its virtual multichannel algorithms. To allow, as a sub-aspect of the present invention, the use of DSP 37 with a standard pair of powered speakers, input 32 allows for the physical speaker separation to be input manually. In a more a general embodiment, other information, say, related to room acoustics, such as distance to rear front walls, reverb, speaker response, variations in HRTFs, or choice of decoding algorithm, could also be supplied at input 32. As shown, however, the preferred embodiment does supply the modified left and right signals L' 15 and R' 16 to their respective speakers 13 and 14. The data on the separation of the speakers is given to the DSP 37 from the speaker enclosure along line 31. In response to this input, the processing algorithm is adjusted for the speaker separation s, so that L'=L'(s) and R'=R'(s).

Figure 6:
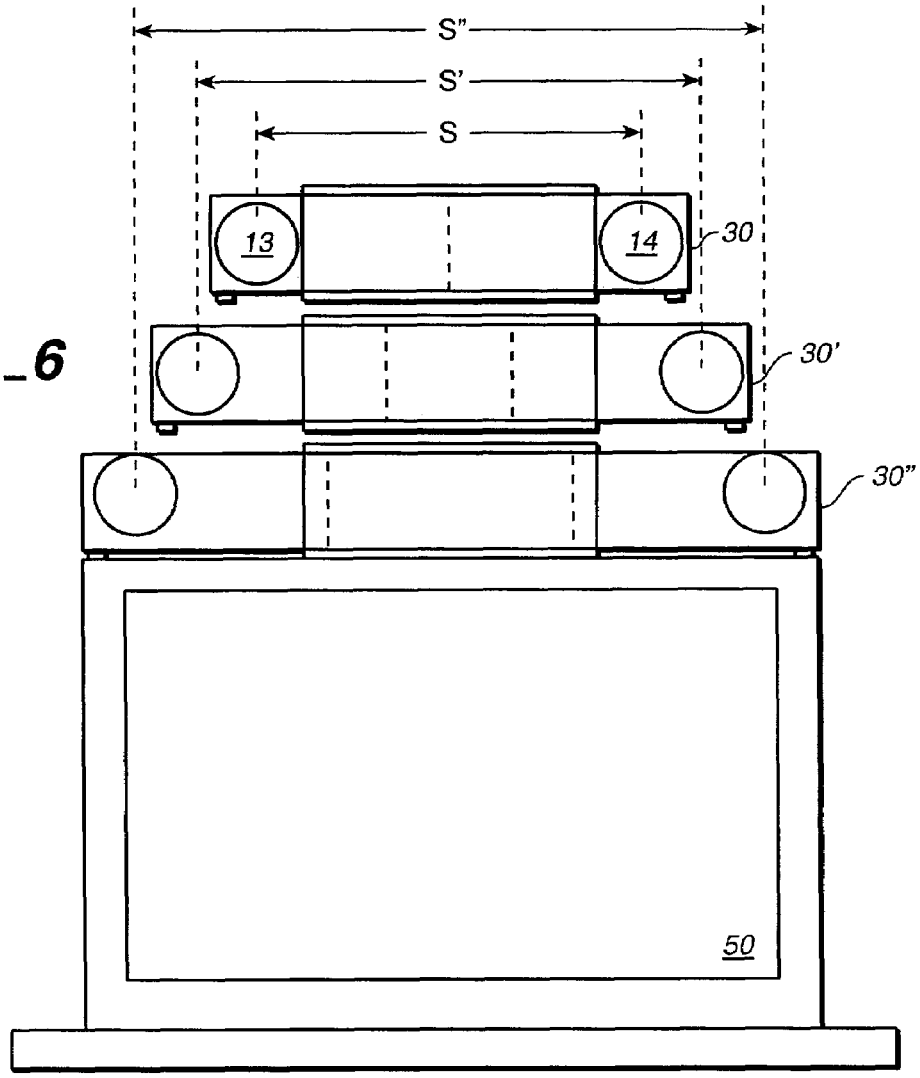
FIG. 6 shows the relation of a speaker enclosure described in the text and its relation to a video monitor.

FIG. 6 shows another sub-aspect of the present invention in the preferred embodiment described above. The speaker enclosure is shown as 30, 30', and 30" adjusted to respective separations s, s' and s". By having the two single drivers in matched housings, relative compliance and alignment variations are minimized. The enclosure joins them by a mechanism that enables the spacing between the speakers to be set to match the width of the underlying supporting surface, typically a TV or computer video monitor. The joining mechanism contains sensors to enable the DSP algorithm to be optimized for the specific spacing. It also serves several practical purposes: The first of these is that of keeping the separation of the speakers within the optimal range for stereo enhancement algorithms, which is somewhat larger than the width of the listeners head. Another is that it will place the speakers in a better vertical alignment, namely, even with or slightly higher than the listener. Finally, it solves the problem of where to place the speakers, a practical difficulty that is often the cause of incorrect speaker placement, by transferring them from the desktop or other valuable area to a space normally not used.

Although the discussion so far has implicitly assumed that the speaker geometry is continuously adjustable and that the algorithms would correspondingly be continuously variable in response, in the preferred embodiment this is not the case. To have the DSP algorithms continuously adjustable would require a more complicated and, consequentially, more expensive implementation. Instead, the preferred embodiment has the algorithm set for a number of discrete values for speaker spacing. By including enough different values, this serves as a practical compromise between cost and complexity. These preset values can be set for a number of standard speaker spacings, say 14 inches, 17 inches, and so on, corresponding to popular monitor sizes on top of which the enclosure would be placed. The DSP could then determine by a look up table, a predetermined table of constants, and/or other processing variables which of the discrete algorithms is appropriate for the spacing range into which the speakers fall.

Figure 7:
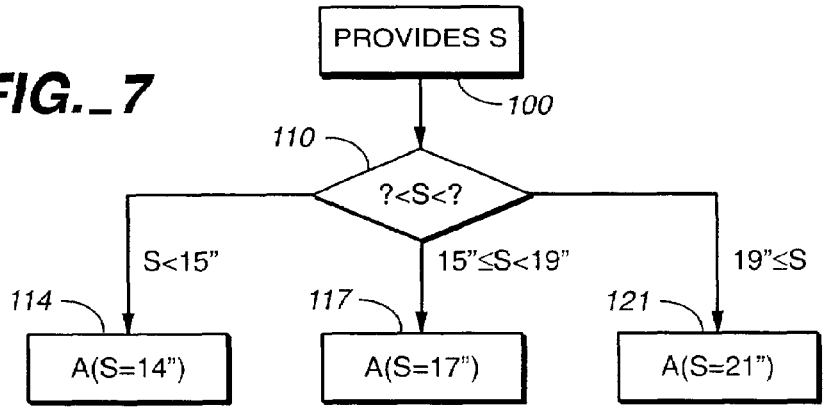
FIG. 7 is a flow chart for determining the correct choice of algorithm in a discrete embodiment of the present invention.

FIG. 7 shows a flow chart for a simplified example of the process. At step 100, the value of s is provided. This can be provided automatically, as in the preferred embodiments described, or entered manually by the user. For the cases described below with more than one pair of speakers, s would be a vector containing the various relative separations of the speakers. At step 110, the value range into which s fits is determined. This is chosen to be one of a set of ranges corresponding to spacing values appropriate to the application. In this example, three ranges corresponding 14, 17, and 21 inches are used: For s<15", an algorithm based on 14" is used in step 114; if 15"≦s<19", an algorithm instead based on 17" is used in step 117; and when 19"≦s, step 121 uses an algorithm based on a 21" separation. Any of the standard enhanced stereo algorithms appropriate to these values could then be employed.

A variation on the above embodiments is the case of the speakers in a constant relationship to each other. The virtual multichannel algorithm can then be conformed to this fixed difference. In this way, an algorithm with parameters for this specific configuration may be incorporated into a circuit for use with a specified speaker configuration, thereby allowing these enhancement parameters to be factory set.

Other aspects of the present invention incorporate such algorithms in the production of signals for rear speakers, which, in one embodiment, also use a speaker enclosure to provide for automatic adjustment of a digital signal processing algorithm. These aspects can be used with sources which provide rear audio signals and also to provide a virtual rear center channel for 5.1 channel home cinema and other applications. A further extension are aspects that apply these signal processors and speaker enclosures to produce audio signals for side speakers to increase sound immersion. The inclusion of side speakers allows for a smoother transition between front sourced sounds and rear sourced sounds in addition to the more accurate placement of sound to the sides.

A number of personal computer audio sources have a provision for rear sound channels. FIG. 8*a* shows such a situation where the audio source 40 now has left and right rear signals on lines 65 and 66 to respective speakers 63 and 64. The front audio channels are as before in FIG. 5. This allows the use of DSP 37 and speaker enclosure 30 for the front channels, where the listeners ability to localizes a sound is more acute, while taking advantage of provided rear channels signals. It should be noted that although the figures refer to powered speakers, since these are common in the personal computer examples being used, other embodiments need not use these and could employ other means for amplification.

Figure 8B:
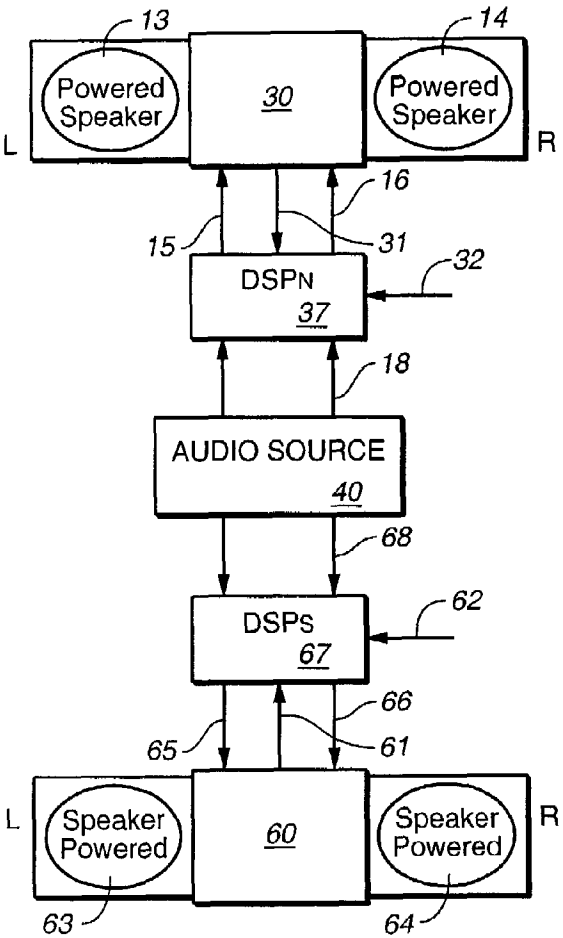
FIG. 8 shows two embodiments of the invention for a audio source with rear sound channels.
Figure 8A:
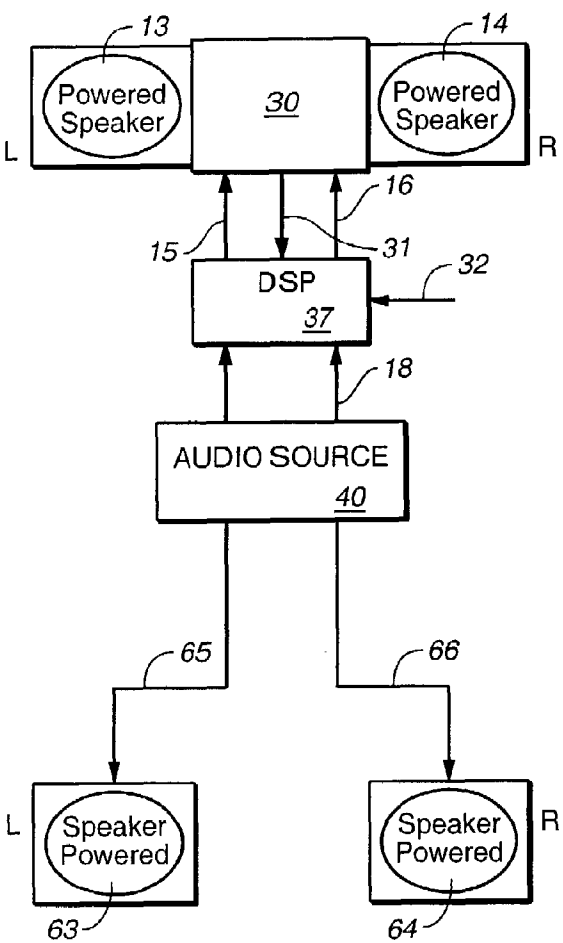

FIG. 8*b* is a preferred variation of the arrangement of FIG. 8*a*. Even though hearing from the rear is less highly localized by the listener, including a second DSP for the rear, $DSP_S$ 67, will produce a virtual multichannel surround sound environment from that direction. This embodiment will employ a speaker enclosure 60 with input 61 back to $DSP_S$ 67 for the rear for automatic adjustment of $DSP_S$'s algorithm, just as the front speaker enclosure 30 does for the front channel processor, now labeled $DSP_N$ 37. To further improve the sound environment, as the sound waves will propagate around the listener differently from the rear than from the front, the preferred embodiment will employ HRTFs appropriate to a rear speaker position in $DSP_S$ 67. Although FIG. 8*b* shows the front enclosure 30 and rear enclosure 60 with the same spacing, this is just for illustrative purposes as these spacing are independent and need not be the same. A unified embodiment could combine $DSP_S$ 67 and $DSP_N$ 37 into a single unit taking both inputs 18 and inputs 68 from audio source 40 as well as the inputs 31 and 61 from respective enclosures 30 and 60.

An embodiment intermediate between FIGS. 8*a* and 8*b* is also possible, where $DSP_S$ 67 is employed, but with speakers 63 and 64 not contained in an enclosure 60 and information on rear speaker geometry now from input 62. This could be due to practicalities of speaker placement or to save on equipment costs. Additionally, any of these variations on FIG. 8*b* could additionally use the separation between the front and the back speaker pairs to modify the algorithms in $DSP_S$ 67 and $DSP_N$ 37 to optimized the sound environment based on this additional input.

Figure 9A:
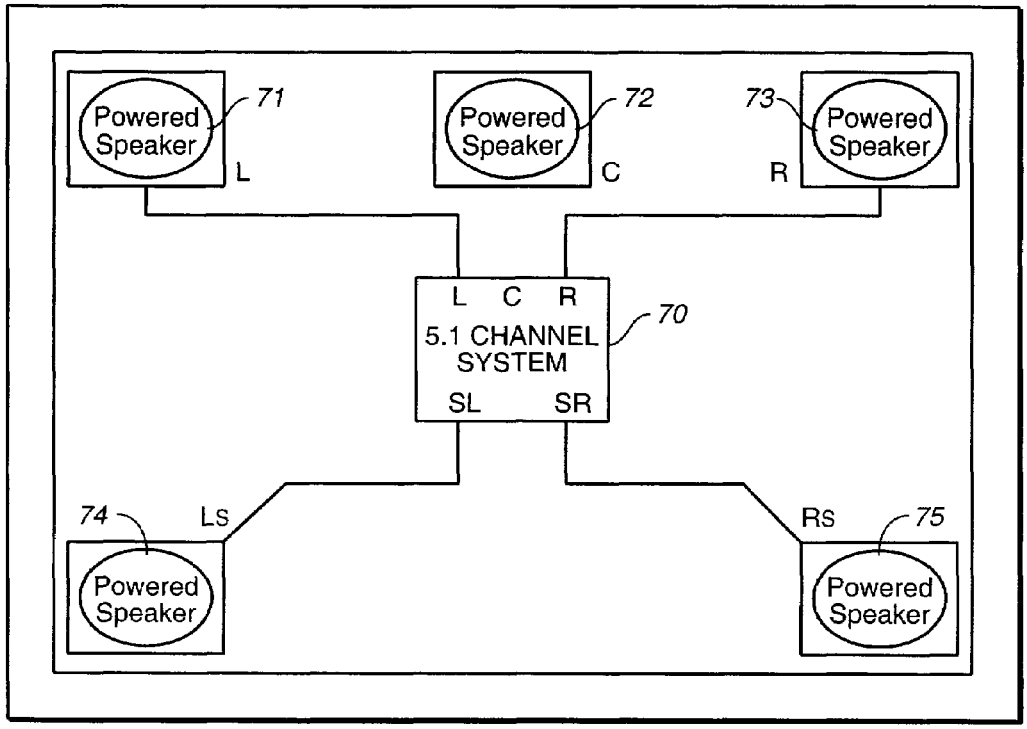
FIG. 9a (PRIOR ART)
FIG. 9*a* shows a 5.1 channel home sound system as commonly arranged in the prior art.
Figure 9B:
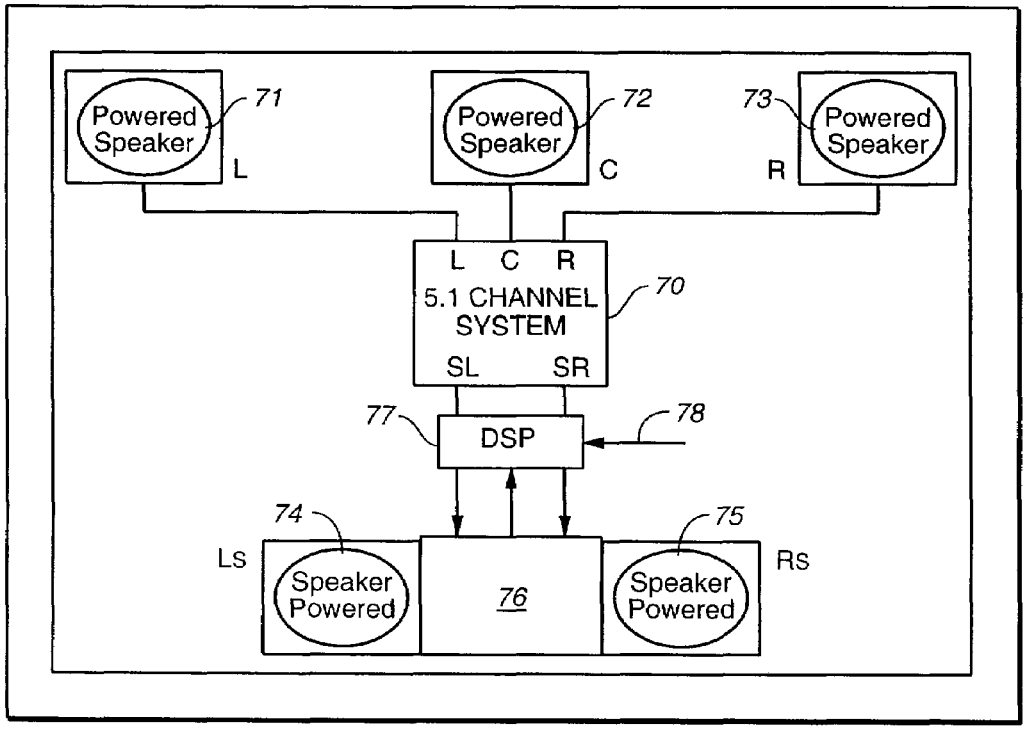
FIG. 9*b* shows a 5.1 channel home sound system employing one aspect of the present invention.

Moving away from the generic example discussed in terms of a PC embodiment, the use of an arrangement enabling adjustment of the speaker spacing with automatic adjustment of the DSP algorithm can be applied to the more specific example of home theater sound systems. FIG. 9*a* shows a prior art arrangement for a 5.1 channel system. This provides for 5 channels of audio sound, with the 1 referring to a non-directional low frequency channel. These five channels are distributed among left, center, and right front channels with respective speakers 71, 72, and 73, and left and right rear, or surround, channels with respective speakers 74 and 75. One aspect of the current invention is employed in a preferred embodiment shown in FIG. 9*b*. Speakers $L_S$ 74 and $R_S$ 75 are now in enclosure 76 connected to DSP 77 in the manner described above with respect to FIGS. 5 and 8*b*. This will now produce a virtual multichannel sound environment for the rear or surround channels, and can produce a virtual center rear channel to correspond to or complement the actual front center channel. An embodiment intermediate between FIGS. 9*a* and 9*b* is again possible, using DSP 77 but with separate speakers $L_S$ 74 and $R_S$ 75 not in a single enclosure 76, information on the geometry of these speakers input at 78.

Figure 10:
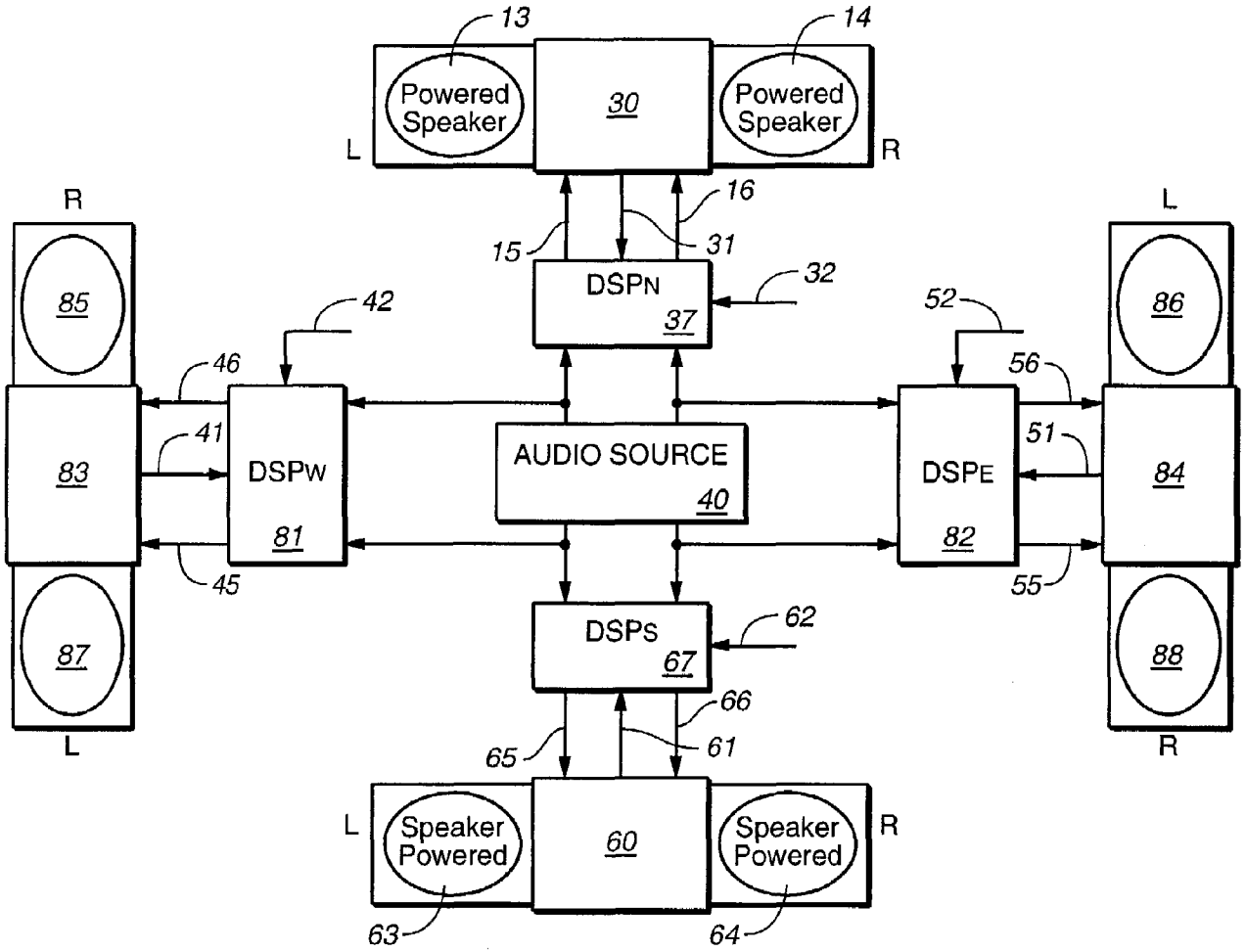
FIG. 10 shows another embodiment with four signal processors and four sets of speakers.
Figure 11:
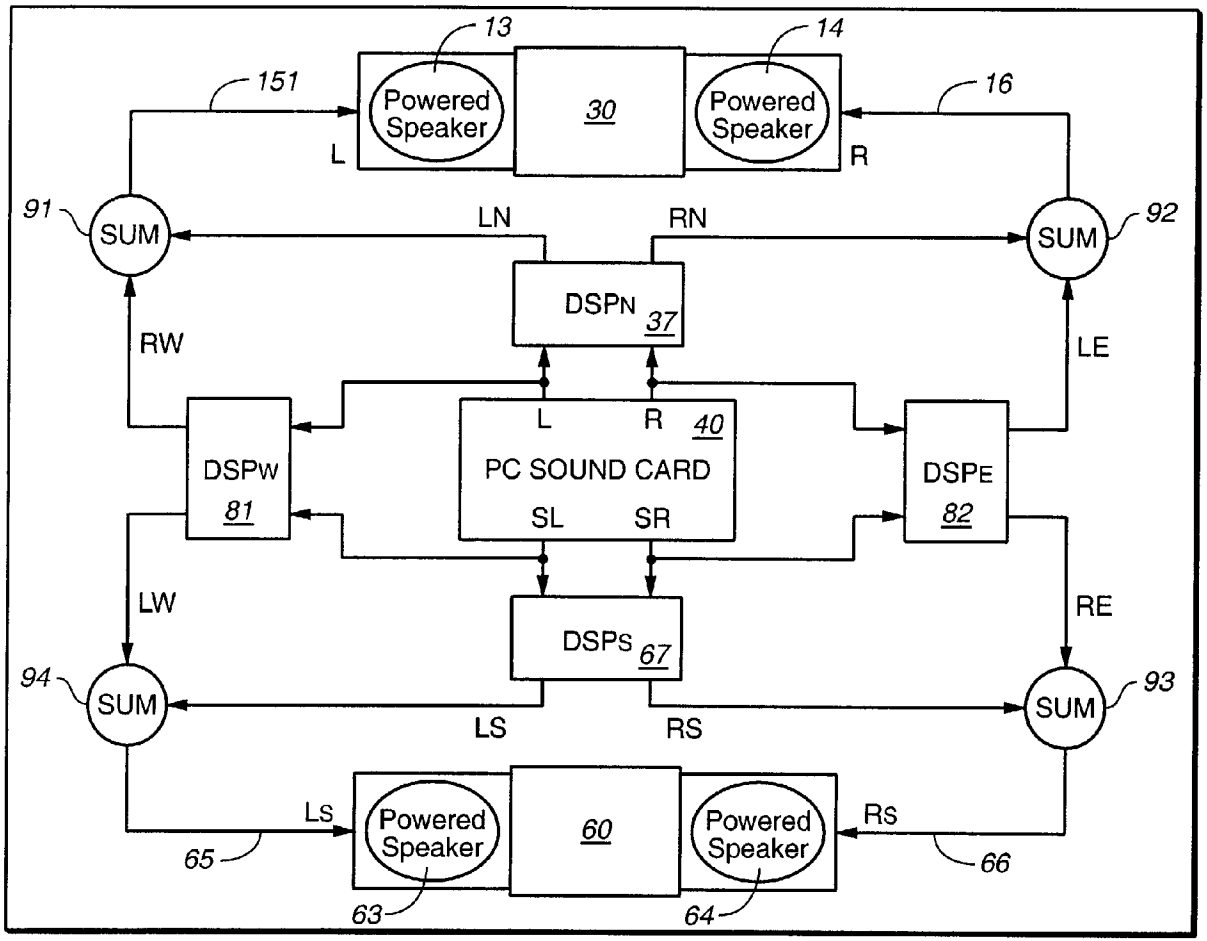
FIG. 11 shows an additional embodiment with four signal processors and two sets of speakers.

Returning to the PC example of an audio source with two front and two rear output signals, FIGS. 10 and 11 present embodiments of two further aspects of the present invention which employ four DSPs. Even with the virtual multichannel enhancement of the present invention applied to both front and rear channels as in FIG. 9*b*, there may still be a large physical gap between the front speaker enclosure 30 and the rear enclosure 60. Representation of sound from the listener's sides will not be as realistic as from placement of actual speakers to the listener's left and right. A preferred embodiment for such an arrangement is shown in FIG. 10.

FIG. 10 starts from the arrangement of FIG. 8*b*, but then adds on two additional speaker enclosure/DSP pairs: $DSP_E$ 82 and enclosure 84 to the right, or east, to produce sound from speakers 86 and 88, and $DSP_W$ 81 and enclosure 83 to the left, or west, to produce sound from speakers 85 and 87. $DSP_E$ 82 and $DSP_W$ 81 receive their input from both front and rear channels. This use of multiple two speaker enclosures will flood the enclosed listening space and produce a smoother transition between front and rear sound location as well as better definition of side source sounds. As with the front and rear signal processors, $DSP_E$ 82 and $DSP_W$ 81 will preferably employ HRTFs appropriate for their relation to the listening area. Although the four pairs of speakers are shown in enclosures 30, 60, 83, and 84, other embodiments could replace any or all of these with just a generic pair of speakers such that any two adjacent speakers in a configuration constitute a two speaker pair.

FIG. 10 shows one preferred embodiment among many variations. As with FIG. 8*b*, one variation could then combine $DSP_S$ 67 and $DSP_N$ 37 into a single front/back unit, with $DSP_E$ 82 and $DSP_W$ 81 into a second left/right unit. Another is to combine the four DSPs 37, 67, 81, and 82 into a single device with four audio inputs for receiving audio data from a 4-channel audio source 40, four pair of speaker outputs, and an input from each of the four speaker enclosures in addition to any manual inputs. Other variations would involve replacing some or all of the speaker enclosures or DSPs with prior art versions in the ways described above for rear surround speakers. Although this deprives the invention of many of its advantages, the inclusion of additional side speakers with a prior art DSP would still give the possibility to improve front-rear transitions and side sourced sounds better that an arrangement which lacked these speakers. For any of these variations, a variation would also include additional provisions for the relative position of speaker pairs in addition to the relative position of individual speakers within a given pair.

One particular environment where the use of side speakers is common, and which would benefit from the DSPs of the invention allowing the physical speaker separation to be input to optimize their algorithms, is in automobiles. The appropriate adaptation of an arrangement such as FIG. 10 to automotive sound systems could greatly improve their perceived sound reproduction, where choice of the appropriate input can be made automatic by coding the wiring harness of different models or through other mechanisms. As with signals from the rear, these side signals would also have HRTFs appropriate to their relation to the listener.

An embodiment of an aspect of the current invention again employing four DSPs 37, 67, 81, and 82, but only two speaker enclosures 30 and 60, is shown in FIG. 11. Again, this should be compared to FIG. 8*b*, of which it is an extension. The DSPs receive their inputs the same as in FIG. 10, but now these signals are summed and returned to only the front pair of speakers 13 and 14 and the rear pair of speakers 63 and 64. The inputs from enclosures 36 and 60 to the DSPs 37, 67, 81, and 82 are suppressed to simplify the drawing.

Adders 91–94 combine signals from the side DSPs with the front and rear DSPs. For example, the left front signal on 15 is now the sum of the left signal from the front DSP 37 and the right signal of the right DSP 81. The result is more wrap around to the sides. The resultant signals are given by:

$$L=k_{1a}LN+k_{1b}RW$$

$$R=k_{2a}RN+k_{2b}LE$$

$$L_S=k_{3a}LS+k_{3b}LW$$

$$R_S=k_{4a}RE+k_{4b}RS.$$

The ks are constants introduced to allow the relative amplitudes to be varied according to the acoustic environment or other needs. For example, in the symmetric situation shown in FIG. 11 placed in a symmetric environment, the choice $k=1/\sqrt{2}$ for all of the ks gives a symmetric output for symmetric adder inputs and results in unit output amplitude for unit adder input amplitudes. This will have much the same advantage as the arrangements discussed with respect to FIG. 10, but in situations where the additional speakers are not desirable or practical.

Various details of the implementation and method are merely illustrative of the invention. It will be understood that various changes in such details may be within the scope of the invention, which is to be limited only by the appended claims.

What is claimed is:

1. A method for modifying the acoustic effect of an array of two or more speakers responsive to a plurality of audio input signals from one or more signal processors, wherein each of said speakers is comprised of one or more acoustic transducers and wherein said two or more speakers are in the same enclosure, the method comprising:

providing one or more parameters of the physical relational characteristics of said speakers with respect to one another in said enclosure; and using at least one of said parameters to modify said audio input signals.

2. The method of claim 1, wherein said physical relational characteristics include the distances between said two or more speakers.

3. The method of claim 1, wherein said physical relational characteristics include the azimuthal alignment of said two or more speakers.

4. The method of claim 1, wherein said physical relational characteristics include the sizes of said two or more speakers.

5. The method of claim 1, wherein said physical relational characteristics include the relative compliance of said two or more speakers.

6. The method of claim 1, wherein said physical relational characteristics include the relative compliance of the portions of the enclosure in which said two or more speakers are mounted.

7. The method of claim 1, wherein said physical relational characteristics include the relative frequency response exhibited by said two or more speakers.

8. The method of claim 1, wherein said physical relational characteristics include the relative phase response exhibited by said two or more speakers.

9. A method for modifying the acoustic effect of an array of two or more speakers mounted in a single enclosure responsive to a plurality of audio input signals from one or more signal processors, wherein each of said speakers is comprised of one or more acoustic transducers, comprising:

providing one or more parameters of the relational characteristics of said speakers with respect to one another as determined by the mounting of the speakers in the enclosure; and using at least one of said parameters to modify said audio input signals.

10. The method of claim 9, wherein said relational characteristics include the distances between said two or more speakers.

11. The method of claim 9, wherein said physical relational characteristics include the azimuthal alignment of said two or more speakers.

12. The method of claim 9, wherein said physical relational characteristics include the sizes of said two or more speakers.

13. The method of claim 9, wherein said physical relational characteristics include the relative compliance of said two or more speakers.

14. The method of claim 9, wherein said physical relational characteristics include the relative compliance of the portions of the enclosure in which said two or more speakers are mounted.

15. The method of claim 9, wherein said physical relational characteristics include the relative frequency response exhibited by said two or more speakers.

16. The method of claim 9, wherein said physical relational characteristics include the relative phase response exhibited by said two or more speakers.

17. A method of producing a sound environment in a listening area from an array of two or more speakers mounted in a shared enclosure, each of said speakers comprised of one or more acoustic transducers and responsive to a respective one of a plurality of audio input signals supplied from one or more signal processors, the method comprising:

receiving a plurality of initial audio signals at said one or more signal processors;

modifying said initial audio signals in said one or more signal processors based on one or more parameters of the physical relational characteristics of said speakers with respect to one another as mounted in the shared enclosure to produce said plurality of audio input signals, wherein at least one of said parameters of the physical relational characteristics of said speakers with respect to one another as mounted in the shared enclosure is predetermined; and supplying said plurality of audio input signals to said respective speakers.

18. The method of claim 17, wherein said predetermined relational parameters include the distances between said two or more speakers.

19. The method of claim 17, wherein said predetermined relational parameters include the azimuthal alignment of said two or more speakers.

20. The method of claim 17, wherein said predetermined relational parameters include the sizes of said two or more speakers.

21. The method of claim 17, wherein said predetermined relational parameters include the relative compliance of said two or more speakers.

22. The method of claim 17, wherein said predetermined relational parameters include the relative compliance of the portions of the enclosure in which said two or more speakers are mounted.

23. The method of claim 17, wherein said predetermined relational parameters include the relative frequency response exhibited by said two or more speakers.

24. The method of claim 17, wherein said predetermined relational parameters include the relative phase response exhibited by said two or more speakers.

25. A sound reproduction system comprising:

a speaker array comprising two or more speakers responsive to a respective plurality of input signals and mounted in an enclosure to hold said speakers in a specified physical relation with respect to one another; and one or more signal processors for providing said plurality of speaker input signals comprising:

an audio input circuit to receive a plurality of initial audio signals;

a processing portion to derive said respective plurality of speaker input signals from said plurality of initial audio signals based on one or more parameters of the specified physical relation of the speakers in the speaker array with respect to one another as held by the enclosure; and an output circuit coupled to said processing portion to provide said respective plurality of speaker input signals to said speaker array.

* * * * *